US007775514B2

(12) United States Patent
Yamamoto

(10) Patent No.: US 7,775,514 B2
(45) Date of Patent: Aug. 17, 2010

(54) SHEET POST-PROCESSING APPARATUS

(75) Inventor: Mikio Yamamoto, Izunokuni (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 662 days.

(21) Appl. No.: 11/678,189

(22) Filed: Feb. 23, 2007

(65) Prior Publication Data

US 2008/0203647 A1 Aug. 28, 2008

(51) Int. Cl.
*B65H 37/04* (2006.01)

(52) U.S. Cl. ..... 270/58.17; 270/58.01; 270/58.07; 270/58.08; 270/58.12; 270/58.13; 270/58.27; 270/58.28

(58) Field of Classification Search ..... 270/52.01, 270/58.01, 58.07, 58.08, 58.09, 58.11, 58.12, 270/58.13, 58.17, 58.27, 58.28
See application file for complete search history.

(56) References Cited

U.S. PATENT DOCUMENTS 5,839,048 A * 11/1998 Kato ..... 399/407
6,381,443 B1 * 4/2002 Kawata et al. ..... 399/407
6,474,633 B1 * 11/2002 Hirai ..... 270/58.09
6,779,790 B2 * 8/2004 Kitahara ..... 270/58.12
6,889,971 B2 * 5/2005 Tamura et al. ..... 270/58.11
2006/0066027 A1 3/2006 Terao et al.
2006/0067768 A1 3/2006 Terao et al.

FOREIGN PATENT DOCUMENTS

| | | |
|---|---|---|
| JP | 08-133549 | 5/1996 |
| JP | 11-171388 | 6/1999 |
| JP | 2002-020020 | 1/2002 |
| JP | 2004-284788 | 10/2004 |

* cited by examiner

*Primary Examiner*—Gene Crawford
*Assistant Examiner*—Leslie A Nicholson, III
(74) *Attorney, Agent, or Firm*—Turocy & Watson, LLP

(57) ABSTRACT

A support member 60 that projects to a sheet conveying direction and supports sheets, which are sorted and discharged, from a rear surface side thereof is provided in a discharge port 7*a* of a processing tray 12 or a standby tray 10. The support member 60 is installed not to interfere with a shutter 52 when the shutter 52 rises. The support member 60 is installed to be inclined upward at an angle equal to or larger than an installation angle of the processing tray 12 or the standby tray 10. The support member 60 may be formed of a conductor that conducts static electricity and installed in a metal section of the discharge port 7*a*.

10 Claims, 11 Drawing Sheets

SHEET POST-PROCESSING APPARATUS

BACKGROUND OF THE INVENTION

1. Field of the Invention

The present invention relates to a sheet post-processing apparatus, and, more particularly to a sheet post-processing apparatus with improved stacking properties for discharged sheets.

2. Description of the Related Art

A sheet post-processing apparatus is used in order to receive sheets from an image forming apparatus and apply post-processing such as stapling, punching, and sorting to the sheets. In performing these kinds of processing, when the sheets are discharged from a processing tray for stacking the sheets to a sheet discharge tray for stacking the sheets after the processing, a leading end of a sheet discharged may hang down and push out sheets already stacked in the sheet discharge tray. This occurs, in particular, in a model that lifts a sheet discharge tray when sheets are discharged.

Concerning this problem, there is proposed a technique for providing, in a discharge port, plural rollers that drive in a pair and providing a guide unit that flips up an end of a sheet parallel to a conveying direction of the sheet, sending the sheet through the rollers formed in a pair to discharge the sheet while curving the sheet (e.g., JP-A-8-133549).

However, in this technique, when plural sheets are discharged, an interval of the rollers has to be adjusted according to the thickness of the sheets and a position of the guide unit has to be moved according to a size of the sheets. Thus, there is a problem in that a mechanism and control are complicated and manufacturing cost increases.

BRIEF SUMMARY OF THE INVENTION

It is an object of the invention to provide a sheet post-processing apparatus with stacking properties for sheets improved by providing, in a discharge port to a discharge tray of a processing tray, a support member that supports sheets, which are sorted and discharged, from a rear surface side thereof.

In an aspect of the present invention, a sheet post-processing apparatus includes a processing tray that receives sheets from an image forming apparatus and receives sheets subjected to post-processing, a sheet discharge tray that stacks sheets discharged after the post-processing, and a support member that is provided in a discharge port to the discharge tray to project to a sheet conveying direction and support sheets, which are sorted and discharged, from a rear surface side thereof.

DETAILED DESCRIPTION OF THE INVENTION

Throughout this description, the embodiments and examples shown should be considered as exemplars, rather than limitations on the apparatus and methods of the present invention.

Figure 1:
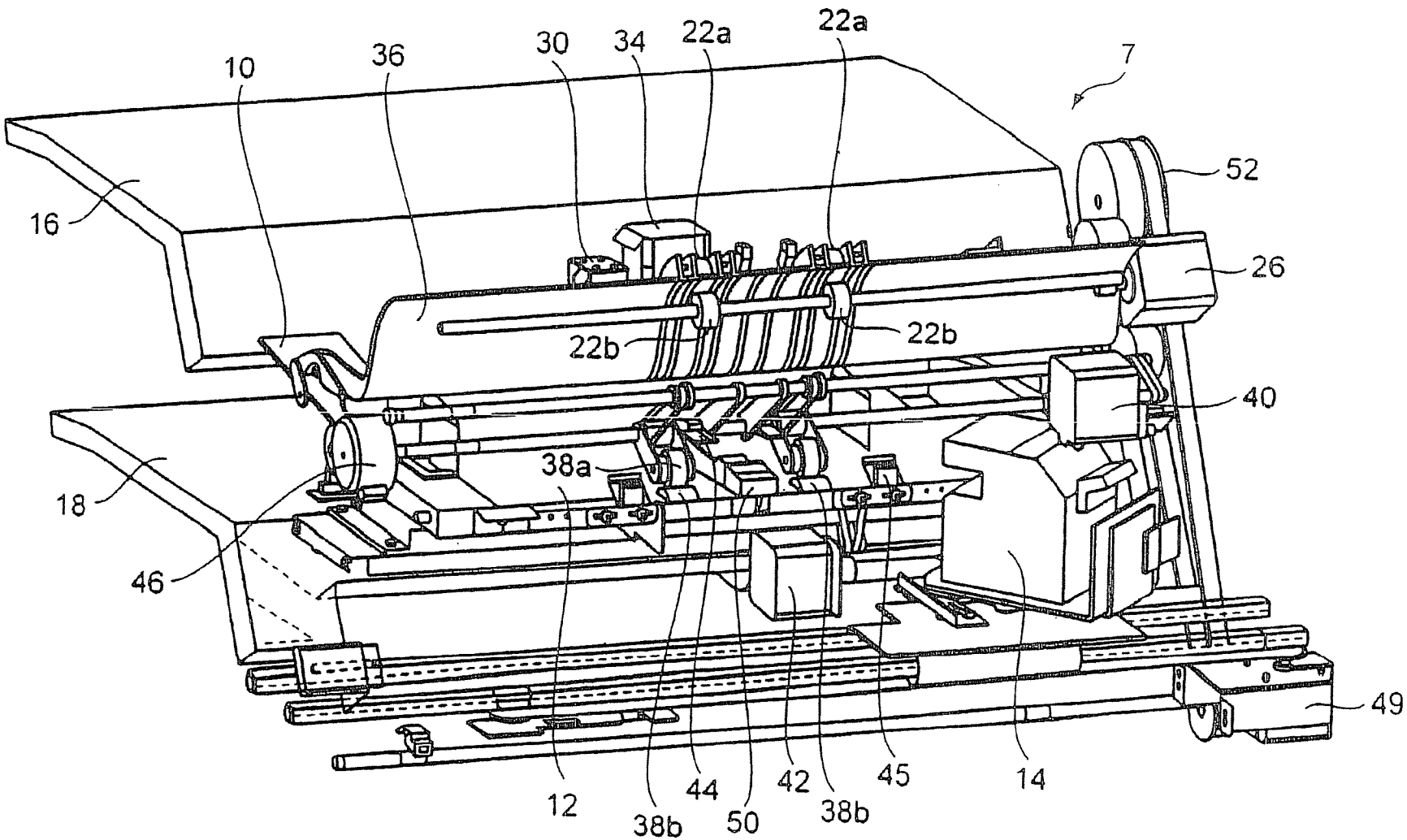
FIG. 1 is a perspective view showing a main part of a sheet post-processing apparatus.
Figure 2:
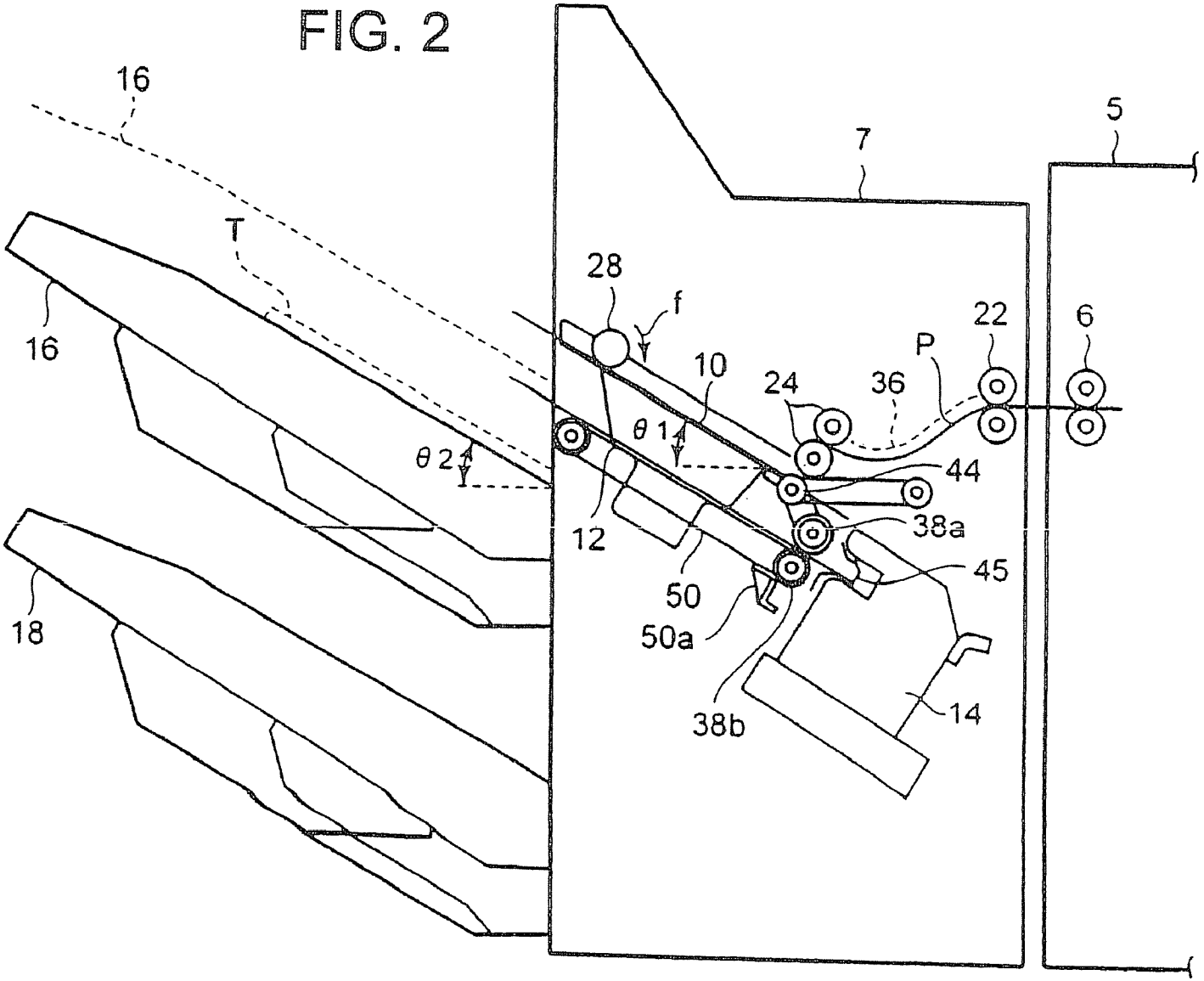
FIG. 2 is a schematic diagram showing a sheet post-processing apparatus arranged adjacent to an image forming apparatus.

Embodiments of the invention will be hereinafter explained using the drawings. In the respective figures, the identical components are denoted by the identical reference numerals and signs and redundant explanations are omitted. FIG. 1 is a perspective view showing a main part of a sheet post-processing apparatus 7 according to an embodiment of the invention. FIG. 2 is a schematic diagram showing the sheet post-processing apparatus 7 arranged adjacent to an image forming apparatus 5 such as a copying machine.

The sheet post-processing apparatus 7 according to this embodiment includes a standby tray 10 that receives sheets from an image forming apparatus and puts the sheets on standby for post-processing, a processing tray 12 that is arranged below the standby tray 10 and receives sheets supplied from the standby tray 10, a stapler 14 that performs staple processing, which is a form of the post-processing, a first sheet discharge tray 16, and a second sheet discharge tray 18.

Sheets P subjected to image formation in the image forming apparatus 5 such as a copying machine and discharged from a pair of sheet discharge rollers 6 are received by a pair of entrance rollers 22, supplied to a pair of sheet feeding rollers 24, and sent from the sheet feeding rollers 24 to the standby tray 10. The entrance rollers 22 are driven by an entrance roller motor 26. A paper path ceiling 36 that guides the sheets P to the sheet feeding rollers 24 is provided between the entrance rollers 22 and the standby tray 10. The entrance rollers 22 include an upper entrance roller 22*a* and a lower entrance roller 22*b*. The sheet feeding rollers 24 also include an upper sheet feeding roller and a lower sheet feeding roller.

Figure 3:
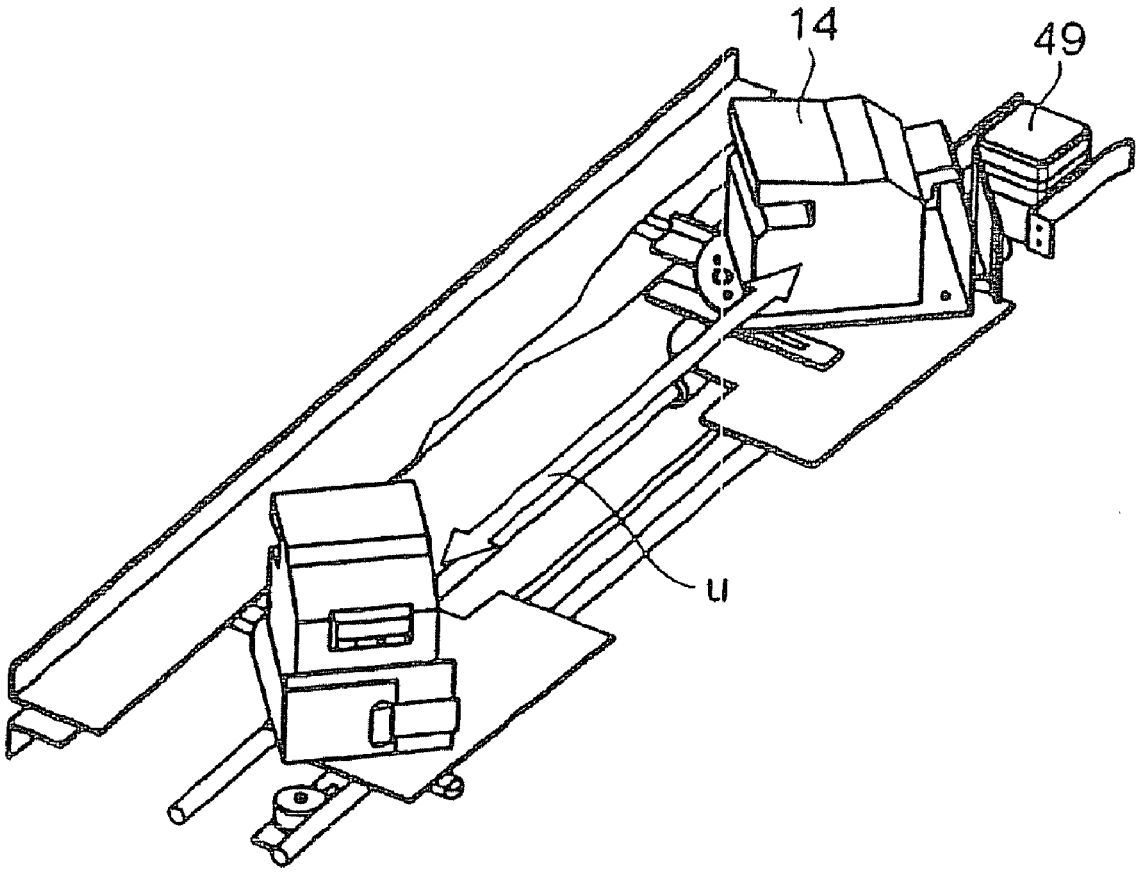
FIG. 3 is a perspective view of a stapler.

The processing tray 12 that stacks the sheets P dropped and supplied from the standby tray 10 is arranged below the standby tray 10. The processing tray 12 aligns and supports the sheets P stacked while the sheets P are subjected to staple processing by the stapler 14 serving as a processing mechanism for performing the post-processing. As shown in FIG. 3, the stapler 14 is positioned by a staple driving unit 49 and the staple processing is controlled by a staple driving unit 49.

Figure 4:
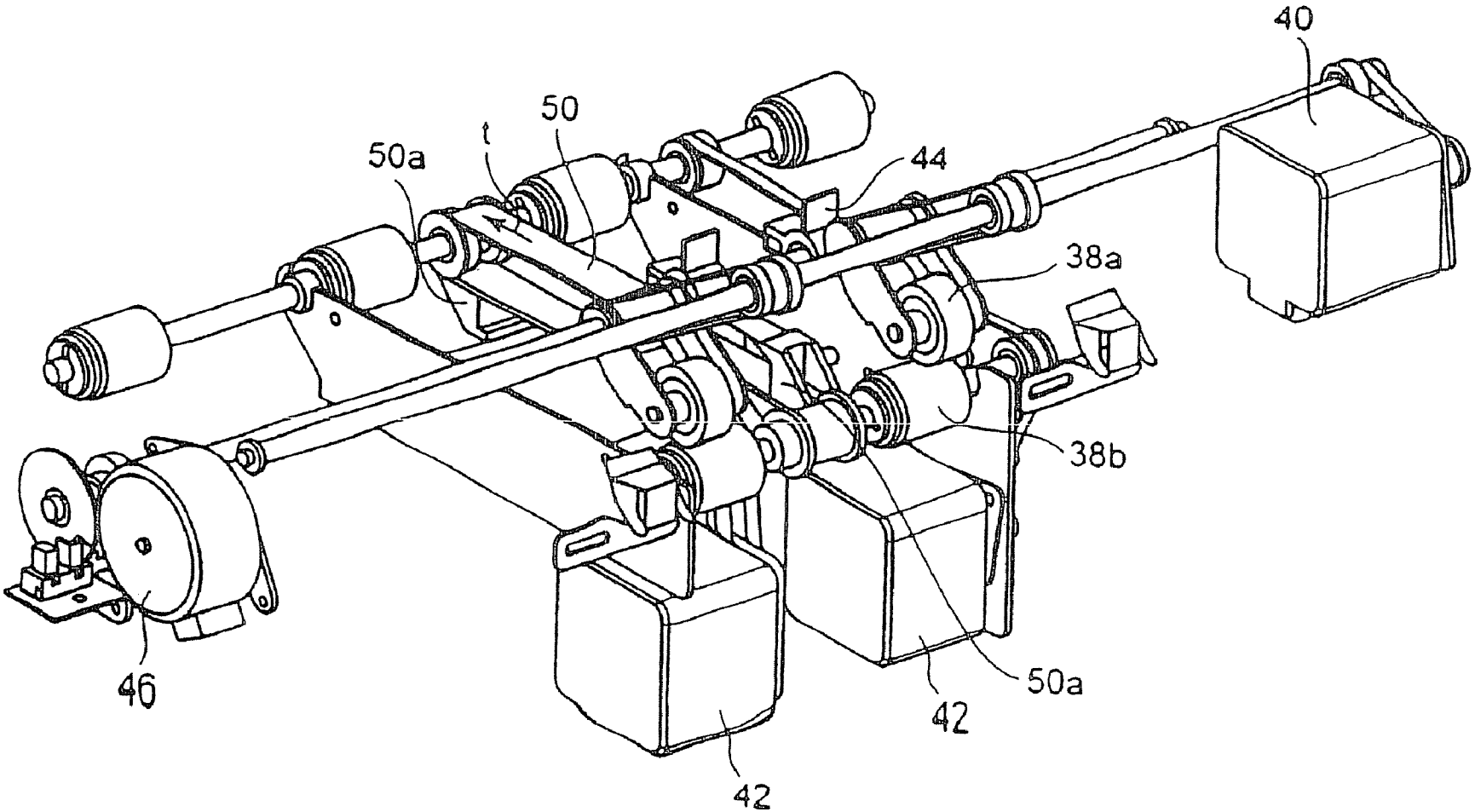
FIG. 4 is a perspective view of a vertical aligning device.

The processing tray 12 has a vertical aligning device that aligns a plurality of the sheets P, which are dropped and supplied from the standby tray 10, in the vertical direction, which is a conveying direction. As shown in FIG. 4, this vertical aligning device has a pair of an upper vertical aligning roller 38*a* and a lower vertical aligning roller 38*b* that align sheets in the vertical direction. The upper and lower vertical aligning rollers 38*a* and 38*b* also function as bundle conveying rollers that hold a sheet bundle T after the finish of the staple processing and take out the sheet bundle T from the stapler 14. The upper vertical aligning roller 38*a* is driven by the vertical aligning upper roller motor 40. The lower vertical aligning roller 38*b* is driven by a vertical aligning lower roller motor 42.

Figure 5:
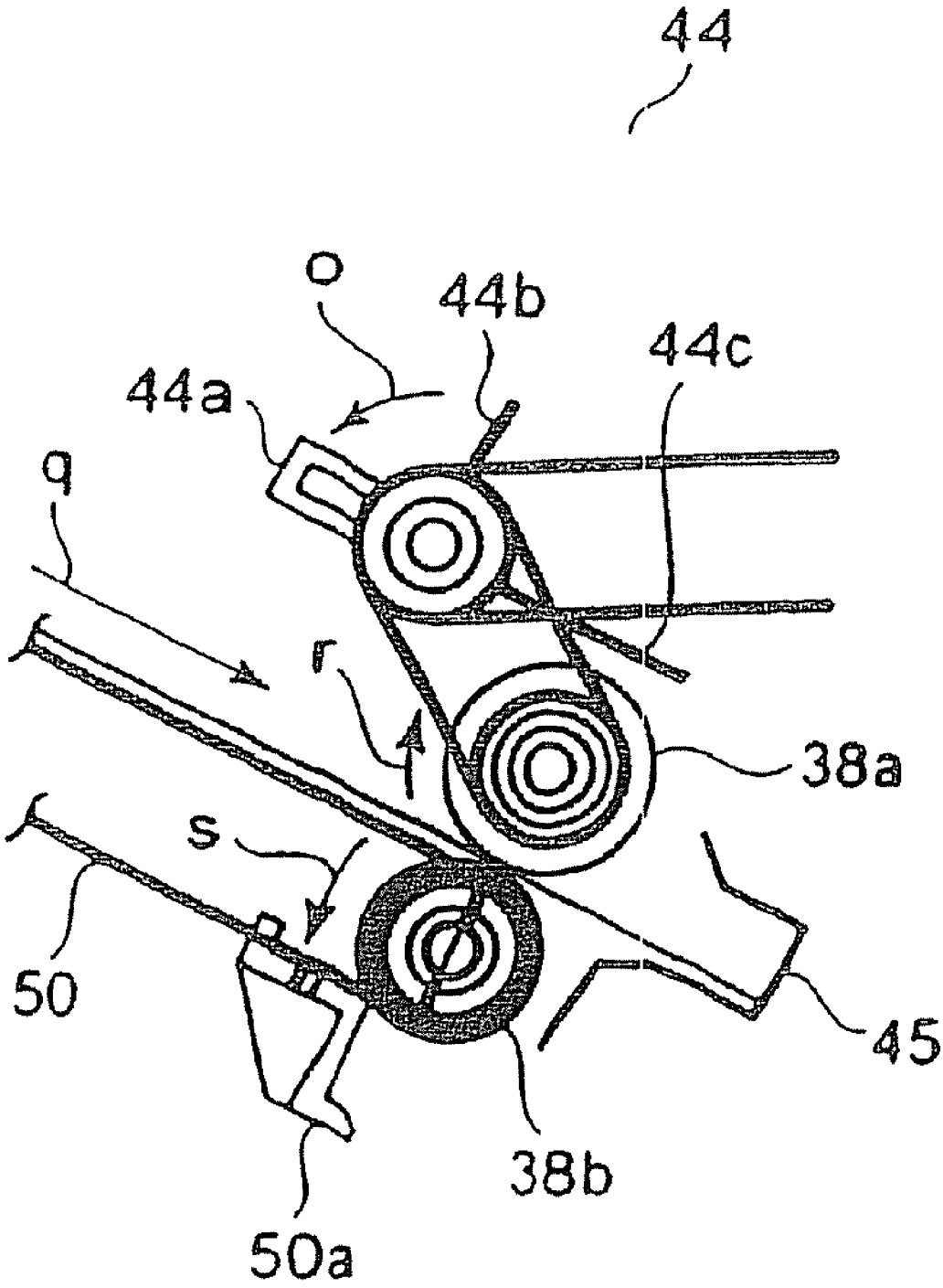
FIG. 5 is a diagram of the vertical aligning device viewed from the side.

In a position to which a trailing end of the sheets P drops when the sheets P are dropped and supplied to the processing tray 12, a rotatable paddle 44 for aligning a top sheet P placed on the processing tray 12 in the vertical direction is arranged. As shown in FIG. 5, the paddle 44 has a receiving unit 44*a* for the sheets P dropped and supplied onto the processing tray 12, a tapping unit 44*b* that taps down the sheets P onto the processing tray 12, and a sending unit 44*c* that aligns the sheets P on the processing tray 12. The paddle 44 is driven by a paddle motor 46. The paddle 44 is formed of a resin or rubber material having elasticity.

A stopper 45 that comes into contact with the trailing end of the sheets P and regulates a trailing end position is provided at an end on the stapler 14 side of the processing tray 12. A conveyor belt 50 that conveys the sheet bundle T, which is subjected to the staple processing and taken out from the stapler 14 by the upper and lower vertical aligning rollers 38*a* and 38*b*, to the first or the second sheet discharge tray 16 or 18 is provided substantially in the center of the processing tray 12. A sending pawl 50*a* that hooks the trailing end of the sheet bundle T is attached to the conveyor belt 50.

Figure 6:
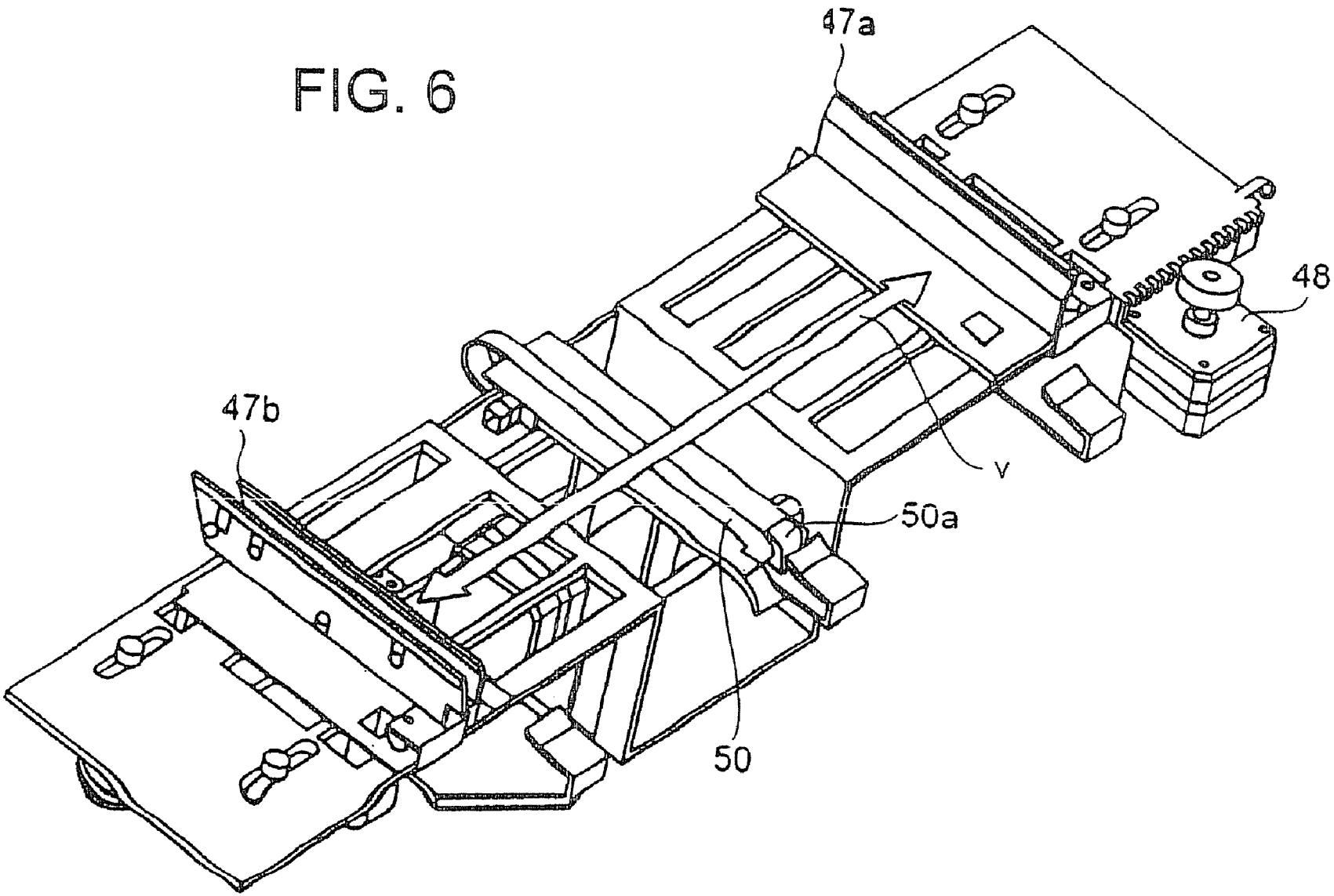
FIG. 6 is a perspective view of a horizontal aligning device.

The processing tray 12 includes a horizontal aligning device that aligns the sheets P in a direction perpendicular to the conveying direction. As shown in FIG. 6, this horizontal aligning device includes a first horizontal aligning plate 47*a* and a second horizontal aligning plate 47*b*. These horizontal aligning plates 47*a* and 47*b* prevent, when the sheets P on the standby tray 10 fall onto the processing tray 12, the sheets P from being disarranged in a horizontal direction perpendicular to the conveying direction and perform horizontal alignment. The horizontal aligning plates 47*a* and 47*b* are slidably formed to be adjusted to the width of the sheets P by the horizontal aligning motor 48.

As shown in FIG. 2, the standby tray 10 is capable of dropping and supplying the sheets P to the processing tray 12 and, on the other hand, is capable of conveying the sheets P in a direction of the first or the second sheet discharge tray 16 or 18. The conveyance of the sheets P in the direction of the sheet discharge tray 16 or 18 is performed by bringing the standby tray roller 28, which performs alignment of the sheets P, into contact with the sheets P on the standby tray 10. Up and down movements of the standby tray roller 28 are controlled by a standby tray roller driving source 30.

The standby tray 10 is arranged at an inclination angle θ1 in order to support the sheets P in a state in which a leading end of the sheets P is higher than a trailing end thereof. The first or the second sheet discharge tray 16 or 18 is lifted and lowered by a sheet-discharge-tray driving unit 52 and selected. The first or the second sheet discharge tray 16 or 18 is lifted and lowered to height substantially the same as the height of the standby tray 10 or the processing tray 12 during stacking of the sheets P to realize improvement of alignability of the sheets P discharged. The first or the second sheet discharge tray 16 or 18 is arranged at an inclination angle θ2 in order to support the sheets P in a state in which the leading end of the sheets P is higher than the trailing end of thereof.

Figure 8:
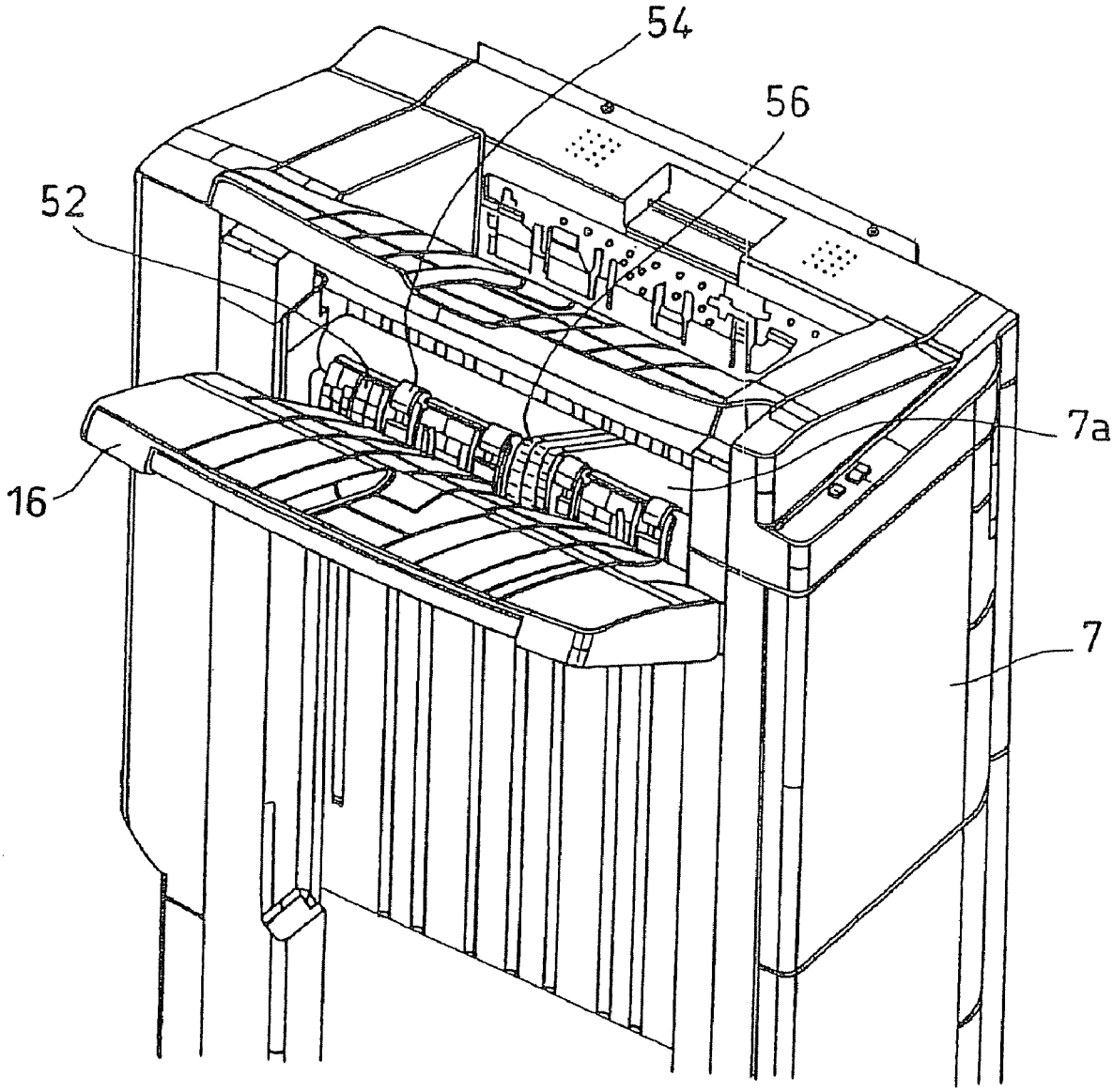
FIG. 8 is a perspective view of the sheet post-processing apparatus viewed from a sheet discharge tray side.

FIG. 8 is a perspective view of the sheet post-processing apparatus viewed from the sheet discharge tray side. As shown in FIG. 8, a shutter 52 is disposed near the sheet discharge tray 16 that receives and stacks sheets discharged from a discharge port of the sheet post-processing apparatus. A shape of a front end of the shutter 52 is formed in a comb-tooth shape. When the post-processing for sheets is not selected and the sheets are discharged to the sheet discharge tray 16, the shutter 52 rises to close an opening of the processing tray 12 and aligns trailing ends of the sheets in discharging the sheets. The front end of the shutter 52 is formed to be inclined or curved to a sheet-conveyance upstream side. In order to count sheets discharged, it is also possible to attach a sheet upper surface detecting sensor that detects an upper surface of the sheets to the shutter 52.

In a discharge outlet 7*a* of a main body of the sheet post-processing apparatus 7, a sheet discharge roller 54 for smoothly performing discharge is provided adjacent to the shutter 52. The height of the front end of the shutter 52 is smaller than the height of the sheet discharge roller 54.

A bundle discharging belt 56 for discharging a sheet bundle is disposed in the center of the discharge outlet 7*a*. The height of the bundle discharging belt 56 is smaller than the height of the front end of the shutter 52. It is also possible to attach a sheet upper surface detecting sensor that detects an upper surface of sheets to the shutter 52.

Figure 9:
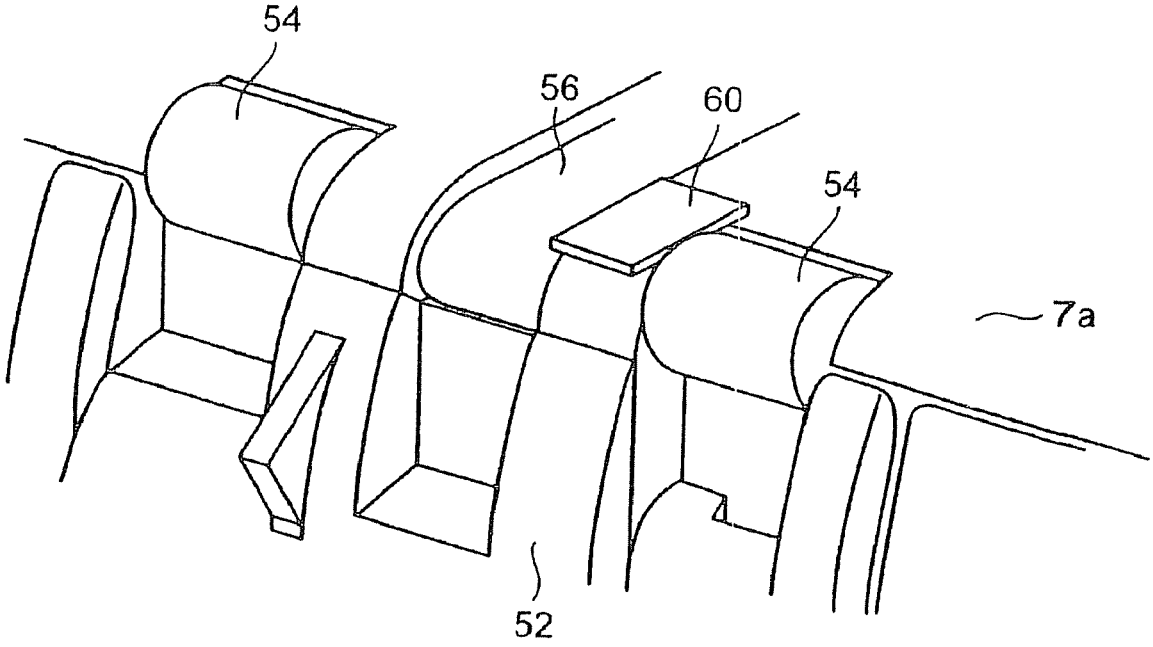
FIG. 9 is an enlarged view of a neighborhood of a bundle discharging belt of the sheet post-processing apparatus.

FIG. 9 is an enlarged view of a neighborhood of the bundle discharging belt 56 of the sheet post-processing apparatus 7. In the discharge outlet 7*a* to the sheet discharge tray 16 of the processing tray 12, a support member 60 that projects to the sheet conveying direction and comes into contact with sheets, which are sorted and discharged, to support the sheets from below, i.e., from a rear surface side of the sheets is provided.

The support member 60 is arranged not to interfere with the shutter 52, i.e., not to come into contact with or touch the shutter 52 when the shutter 52 rises. Alternatively, the support member 60 is made of an elastic member that easily deforms and does not hinder an operation of the shutter even if some interference occurs.

Sheets, which are sorted and discharged, are stacked on the sheet discharge tray 16 while being alternately shifted for each predetermined number of sheets by width set in advance. Sheet bundles stacked on the sheet discharge tray 16 alternately overlap only in a part thereof. The support member 60 is provided in a portion of the discharge outlet 7*a* located in an area in which the sheet bundles overlap one another. A plurality of the support members 60 may be provided in this portion of the discharge outlet 7*a* located in the area in which the sheet bundles overlap one another.

The support member 60 may be formed of a conductor that conducts static electricity and provided in a ground-connected metal portion near the discharge outlet 7*a*. It is possible to use metal as a material of the conductor. In particular, stainless steel is desirable. It is desirable that the support member 60 is formed in a tabular shape or a brush shape. The support member 60 is adhered by, for example, a screw or an adhesive. It is possible to use a conducive adhesive as the adhesive.

Figure 10:
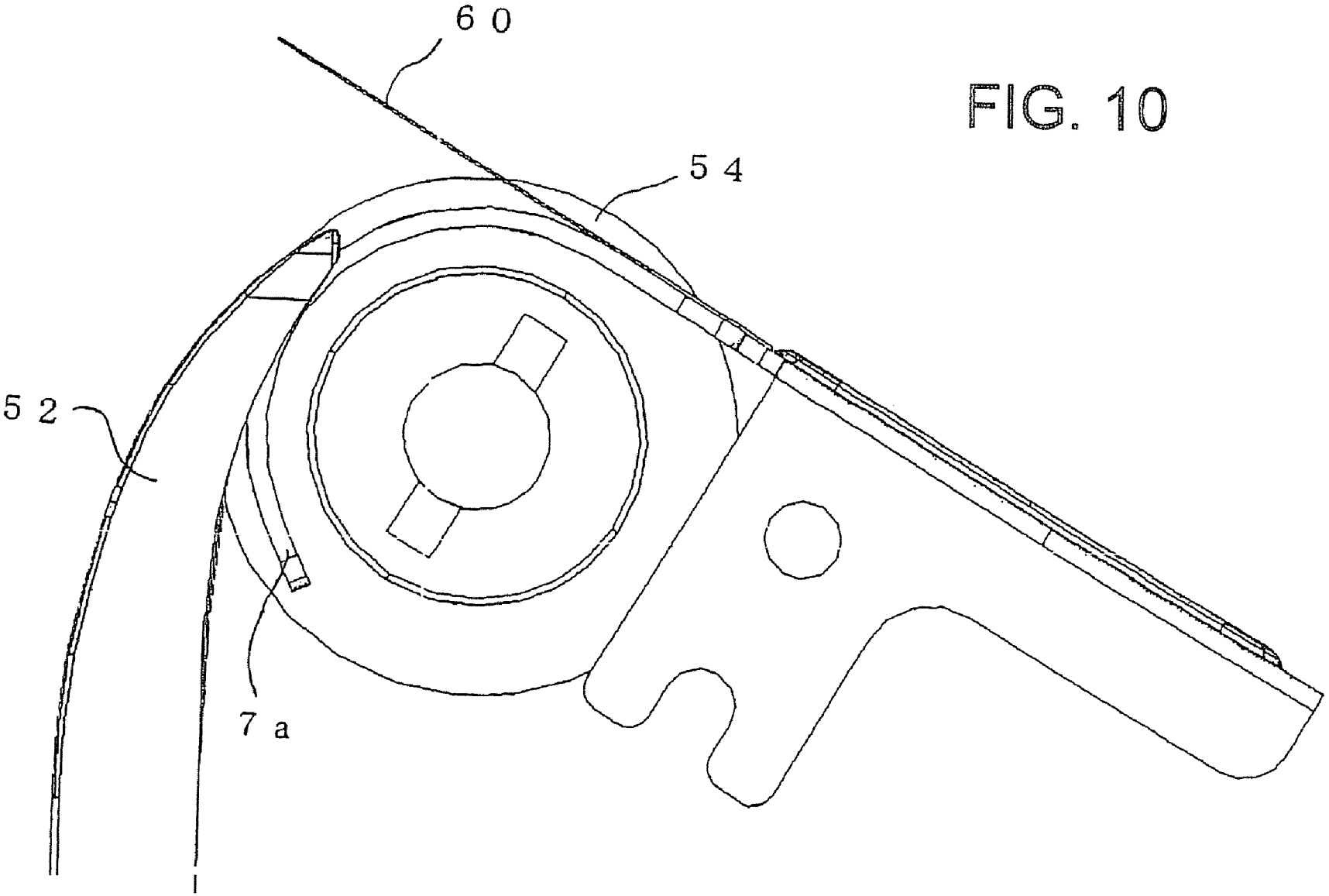
FIG. 10 is a diagram of a support member viewed from the side.

FIG. 10 is a diagram of the support member 60 viewed from the side. The support member 60 is inclined upward at an angle equal to or larger than an inclination angle of the processing tray 12. As shown in FIG. 2, the processing tray 12 is disposed to be inclined such that a sheet leading end side thereof is high and a sheet trailing end side thereof is low. This installation angle is set to prevent, when a sheet is discharged to the sheet discharge tray 16, the discharged sheet from pushing out sheets already discharged. The support member 60 provided to be inclined upward at an angle equal to or larger than the installation angle of the processing tray 12.

As shown in FIG. 10, the support member 60 is arranged lower than a disposed position of the sheet discharging roller 54. The sheet discharging roller 54 is disposed on a sheet conveyance outlet side of the processing tray 12 and conveys a sheet delivered from the processing tray 12. When viewed in section, a curved surface of the sheet discharging roller 54 is located above a plane formed by the support member 60. Therefore, a discharged sheet is conveyed such that a rear side thereof comes into contact with the support member 60 after passing above the sheet discharging roller 54.

It is also possible to provide the support member 60 in a discharge outlet of the standby tray 10 as described above.

Actions will be described. When the sheets P are subjected to image formation in the image forming apparatus 5 and supplied from the sheet discharging roller 6, the sheet post-processing apparatus 7 performs different kinds of operation depending on whether the post-processing for the sheets P is performed or not performed or whether the post-processing for the preceding sheets P is being executed or the post-processing has been finished.

When the post-processing is not performed, for example, the first sheet discharge tray 16 has slid to a position indicated by a dotted line in FIG. 2 and is capable of stacking, with high alignability, the sheets P discharged from the standby tray 10. When the post-processing is not performed, the sheets P conveyed from the entrance rollers 22 to the sheet feeding rollers 24 via the paper path ceiling 36 are fed to the standby tray 10 by the sheet feeding roller 24. Subsequently, the sheets P are lowered onto the standby tray 10, conveyed by the standby tray roller 28 rotated in an arrow f direction, and discharged to the first sheet discharge tray 16.

In this way, sheets are sequentially stacked on the first sheet discharge tray 16. The first sheet discharge tray 16 is arranged to have an inclination angle θ2 and a leading end of the sheets is higher than a trailing end of the sheets. Thus, for example, even if the sheets P are discharged onto the first sheet discharge tray 16 in a state in which the sheets P are curled as indicated by a dotted line in FIG. 9, the sheets P placed on the first sheet discharge tray 16 earlier are not pushed out by contact with the leading end of the following sheet P. In other words, the discharged sheets P are sequentially placed on the sheet discharge tray 16 in order without being disordered. Even if the preceding sheets P are pushed by the following sheet P and some positional shift is caused, since the first sheet discharge tray 16 has the inclination angle θ2, the sheets P fall because of their own weight and are aligned and stacked in a state in which the trailing end thereof is even on the first sheet discharge tray 16.

When sheets subjected to image formation in the image forming apparatus 5 are received and the post-processing such as stapling and sorting is not performed, the sheet discharge tray 16 or 18 does not perform any up and down operation at all until sheets discharged from the sheet post-processing apparatus 7 reach a predetermined number. It is possible to count the number of discharged sheets with, for example, a sheet upper surface detecting sensor (not shown) that detects an upper surface of sheets.

When sheets stacked on the sheet discharge tray 16 or 18 reach the predetermined number, the sheet discharge tray 16 or 18 performs the up and down operation and a sheet trailing end is prevented from remaining in the sheet discharge port (not shown) of the sheet post-processing apparatus 7 to perform accurate upper surface detection.

It is suitable that, after the sheets reach the predetermined number, a standstill state of the sheet discharge tray 16 or 18 is maintained until the sheet upper surface sensor is in the ON state for a predetermined time or more, for example, 5 msec or more. This is because, in general, presence of a dead zone is inevitable in actuators of various sensors and the like.

Here, the upper surface of the sheets is detected in order to manage the number of sheets on the sheet discharge tray 16 or 18 not to exceed a stackable number of sheets thereof and grasp a present movable position of the sheet discharge tray 16 or 18.

The set number of sheets described above may be set as, for example, forty as a default at the time of shipment of the sheet post-processing apparatus 7 or a user may be able to set the number of sheets.

A stroke amount of the up and down operation of the sheet discharge tray 16 or 18 is set to at least about 50 mm. This is because, when the stroke amount is too small, hooking at the sheet trailing end cannot be released. On the other hand, when the stroke amount is too large, the up and down operation of the sheet discharge tray 16 or 18 takes time and productivity is deteriorated.

The stroke amount of the up and down operation of the sheet discharge tray 16 or 18 may be set as a default at the time of shipment of the sheet post-processing apparatus 7 or the user may be able to set the stroke amount.

It is suitable that the up and down operation of the sheet discharge tray 16 or 18 is faster at the time of lowering than at the time of lifting. This is because sheets fall to the sheet discharge tray 16 or 18 faster.

A case in which the staple processing as the post-processing is performed and there is no sheets P, for which the staple processing is being executed earlier, on the processing tray 20 will be described.

Figure 7:
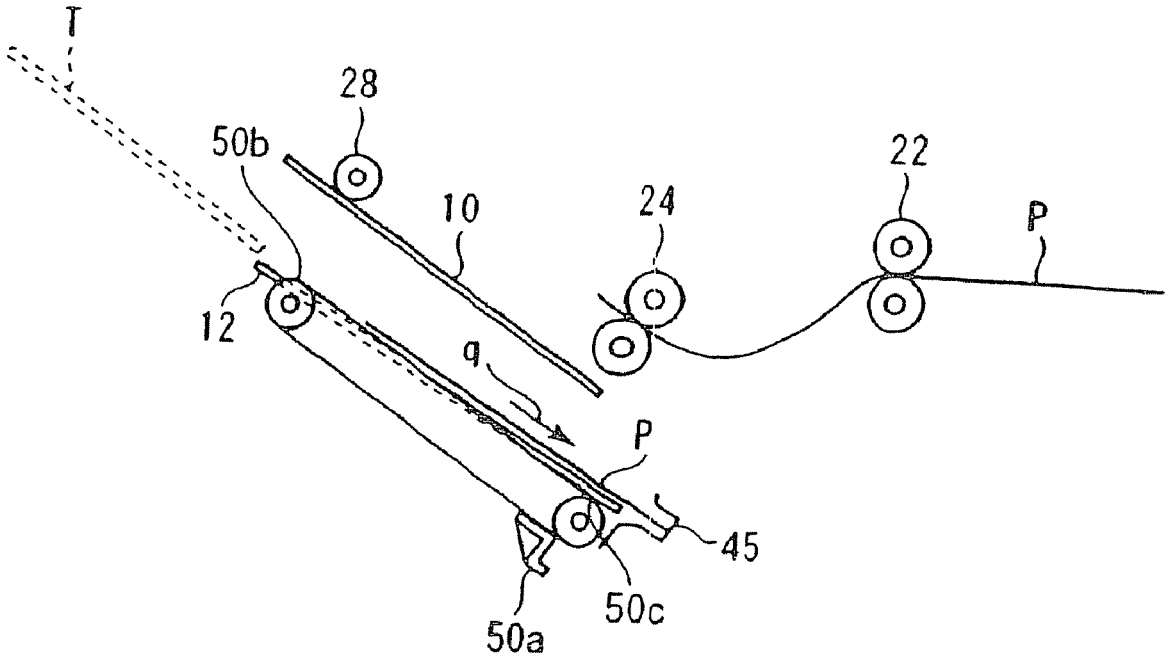
FIG. 7 is a diagram of a standby tray and a processing tray viewed from the side.

In this case, the standby tray 10 drops and supplies the sheet P onto the processing tray 12. As shown in FIG. 7, in order to align the horizontal direction of the dropping sheet P, the horizontal aligning plates 47*a* and 47*b* are arranged such that an interval between the horizontal aligning plates 47*a* and 47*b* is substantially the same as the width of the sheet P. Consequently, the sheet P fed by the sheet feeding rollers 24 is dropped and supplied onto the processing tray 12 through the standby tray 10.

During the drop and supply, the upper vertical aligning roller 38*a* is retracted upward and the receiving unit 44*a* of the paddle 44 receives the trailing end of the sheet P. Both the sides of the sheet P fall while being in contact with the horizontal aligning plates 47*a* and 47*b* and the sheet P is aligned in the horizontal direction. Subsequently, the paddle 44 rotates in an arrow o direction, drops the trailing end of the sheet P from the receiving unit 44*a*, and taps down the sheet P onto the processing tray 12 with the tapping unit 44*b*. Moreover, the paddle 44 sends the sheet P in an arrow q direction with the sending unit 44*c*, brings the trailing end of the sheet P into contact with the stopper 45, and completes the alignment in the vertical direction of the sheet P. The alignment in the vertical direction of the sheet P on the processing tray 12 may be performed by the upper vertical aligning roller 38*a* by moving up and down the upper vertical aligning roller 38*a* every time the alignment is performed.

In this way, the sheets P subjected to image formation are stacked on the processing tray 12 from the sheet feeding rollers 24 through the standby tray 10 while being sequentially aligned in the horizontal direction and the vertical direction. When the sheets P reach the predetermined number, the stapler 14 staples the sheets P on the processing tray 12 in a desired position in a bundle to form the sheet bundle T. Thereafter, the upper vertical aligning roller 38*a* is lowered onto the sheet bundle. The sheet bundle T is held by the upper vertical aligning roller 38*a* rotating in an arrow r direction and the lower vertical aligning roller 38*b* rotating in an arrow s direction to be conveyed in a direction of the first sheet discharge tray 16.

When the trailing end of the sheet bundle T passes the upper and the lower vertical aligning rollers 38*a* and 38*b*, the trailing end is hooked by the sending pawl 50*a* of the conveyor belt 50 rotated in an arrow t direction and discharged onto the first sheet discharge tray 16.

At this point, the first sheet discharge tray 16 is slid from the position indicated by the dotted line to a position indicated by a solid line in FIG. 2. Since the first sheet discharge tray 16 is arranged to have the inclination angle θ2 and the sheet leading end is higher than the trailing end, the sheets P discharged onto the first sheet discharge tray 16 earlier are not pushed out because of contact with the leading end of the following sheet bundle T. Even if the preceding sheet bundle T is pushed by the following sheet P and some positional shift is caused, since the first sheet discharge tray 16 has the inclination angle θ2, the sheet bundle T falls because of its own weight and is aligned and stacked in a state in which the trailing end thereof is even on the first sheet discharge tray 16. The staple processing for the sheets P is completed.

A case in which the staple processing as the post-processing is performed and the sheets P, for which the staple processing is being executed earlier, remain in the processing tray 20 will be described.

In this case, the standby tray 10 is capable of supporting the sheets P. The standby tray roller 28 is retracted to above the standby tray 10 not to hinder the sheets P. The sheets P discharged from the image forming apparatus 5 and supplied by the sheet feeding rollers 24 are temporarily placed on the standby tray 10 in order to wait for the processing tray 12 to be empty.

The sheets P placed on the standby tray 10 is vertically aligned by the standby tray roller 28 rotated in a direction opposite to the arrow f direction. Moreover, since the standby tray 10 is arranged to have the inclination angle θ1 and the sheet leading end is higher than the trailing end, the sheets P are vertically aligned by their own weights as well.

Since the standby tray 10 is arranged to have the inclination angle θ1, for example, even if the sheets P are supplied from the sheet feeding rollers 24 and fed onto the standby tray 10 in a state in which the sheets P are curled, the sheets P placed on the standby tray 10 earlier are not pushed out by contact with the leading end of the following sheet P. In other words, the supplied sheets P are placed on the standby tray 10 in order without being disordered. Even if the preceding sheets P are pushed by the following sheet P and some positional shift is caused, since the standby tray 10 has the inclination angle θ1, the sheets P fall because of their own weight and are aligned and stacked in a state in which the trailing end thereof is even on the standby tray 10.

When the preceding sheets P on the processing tray 12 are discharged to the first sheet discharge tray 16 side and the processing tray 12 is emptied, the standby tray 10 drops and supplies the sheets P onto the processing tray 12. At this point, the horizontal aligning plates 47*a* and 47*b* are arranged such that an interval between the aligning plates is substantially the same as the width of the sheets P. Therefore, both the sides of the sheets P dropped from the standby tray 10 are regulated by the horizontal aligning plates 47*a* and 47*b* and the horizontal direction of the sheets P is aligned.

The sheet P on the lower side of the two sheets P dropped to the processing tray 12 is sent in the arrow q direction by the lower vertical aligning roller 38*b* rotated in the direction opposite to the arrow s direction, the trailing end of the sheet P is brought into contact with the stopper 45, and the alignment in the vertical direction of the sheet P is completed. The sheet P on the upper side of the two sheets P dropped to the processing tray 12 is sent in the arrow q direction by the upper vertical aligning roller 38*a* rotated in the direction opposite to the arrow r direction, the trailing end of the sheet P is brought into contact with the stopper 45, and the alignment in the vertical direction of the sheet P is completed. Thereafter, the upper vertical aligning roller 38*a* is retracted upward.

The third and subsequent sheets P discharged from the image forming apparatus 5 are directly dropped and supplied to the processing tray 12 without being put on standby on the standby tray 10. Thereafter, the third and subsequent sheets P are sequentially aligned on the sheets P, which are stacked on the processing tray 12 earlier, by the paddle 44.

When the sheets P stacked on the processing tray 12 reach the predetermined number, the sheets P are subjected to the staple processing by the stapler 14 to form the sheet bundle T. Thereafter, the sheet bundle T is conveyed in the direction of the first sheet discharge tray 16 by the upper and the lower vertical aligning rollers 38*a* and 38*b*, the trailing end of the sheet bundle T is hooked by the sending pawl 50*a* of the conveyor belt 50, the sheet bundle T is discharged onto the first sheet discharge tray 16, and the staple processing for the sheets P is completed.

Figure 11A:
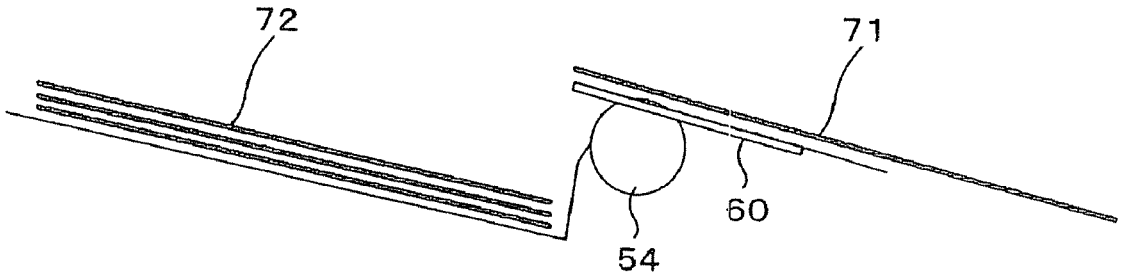
FIG. 11 is a diagram schematically showing a state in which sheets are discharged in an embodiment of the invention.
Figure 11B:
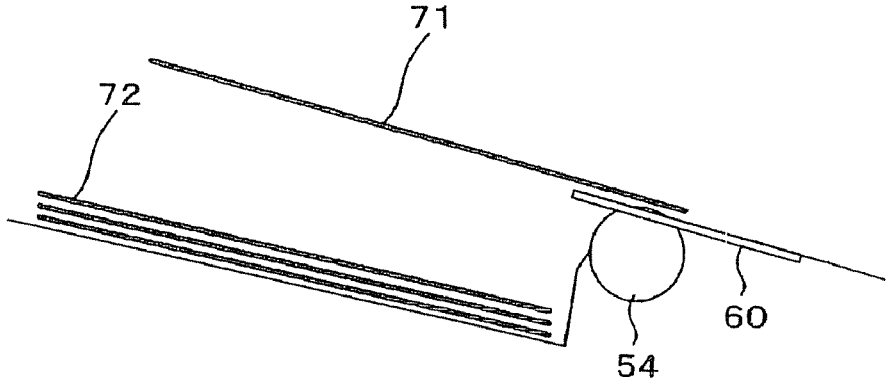
Figure 11C:
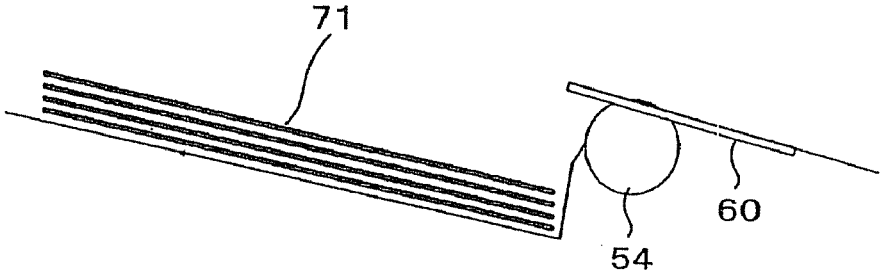

FIG. 11 is a diagram schematically showing a state in which sheets are discharged passing above the support member 60. As shown in FIG. 11(*a*), a sheet 71 for which the post-processing is finished is discharged by the sheet discharging roller 54 and the bundle discharging belt 56. Since a leading end of the sheet 71 is supported from a rear side by the support member 60, hang-down does not occur even if the sheet 71 passes over the sheet discharging roller 54.

As shown in FIG. 11(*b*), the sheet 71 is sequentially discharged onto the sheet discharge tray 16 by the sheet discharging roller 54 rotating at predetermined speed. As shown in FIG. 11(*c*), the sheet 71 is stacked on the sheet discharge tray 16 without pushing out sheets 72 already discharged.

When the support member 60 is formed of a conductor that conducts static electricity and installed in a metal part of the discharge outlet 7*a*, static electricity charged in sheets to be discharged is removed by the support member 60. Therefore, it is also possible to prevent the sheets to be discharged from interfering with sheets already discharged.

As described above, in the sheet post-processing apparatus 7 according to this embodiment, the support member that projects to the sheet conveying direction and supports sheets, which are sorted and discharged, from below is provided in the discharge outlet 7*a* of the processing tray 12 or the standby tray 10. Thus, a leading end of a sheet to be discharged does not hang down. It is possible to prevent the sheets, which are sorted and discharged, from pushing out sheets already discharged to the sheet discharge tray 16.

When the support member 60 is formed of a conductor that conducts static electricity and installed in a metal section of the discharge outlet, it is possible to obtain an effect of removing static electricity.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A sheet post-processing apparatus comprising:

a processing tray that receives sheets subjected to image forming from an image forming apparatus and stacks the sheets in order to perform post-processing;

a sheet discharge tray that stacks the sheets discharged after the post-processing;

a shutter for rising to close, when the post-processing of the sheets is not selected and the sheets are discharged to the sheet discharge tray, an opening of the processing tray and aligning trailing ends of the sheets when the sheets are being discharged;

a support member that is provided near a discharge port to the discharge tray, projects to a sheet conveying direction, and supports sheets to be discharged from a back surface side thereof, and is arranged not to interfere with the shutter when the shutter rises.

2. A sheet post-processing apparatus according to claim 1, wherein the processing tray is disposed in the sheet post-processing apparatus to be high on a sheet leading end side and low on a sheet trailing end side in the sheet conveying direction, and the support member is inclined upward at an angle equal to or larger than an angle of installation of the processing tray.

3. A sheet post-processing apparatus according to claim 1, comprising a sheet discharging roller that conveys the sheets delivered from the processing tray, wherein the support member is arranged lower than a disposed position of the sheet discharging roller.

4. A sheet post-processing apparatus according to claim 1, wherein the support member is formed of a conductor and provided in a metal part of the discharge port.

5. A sheet post-processing apparatus according to claim 1, wherein a plurality of the support members are provided in a section of the discharge port located in an area where bundles of sheets alternately discharged for each predetermined number of sheets overlap one another.

6. A sheet discharging method of a sheet post-processing apparatus comprising:

supporting sheets to be discharged from a back side thereof by a supporting member that is provided near a discharge port to a discharge tray, projects to a sheet conveying direction, and is arranged not to interfere with a shutter when the shutter rises;

aligning trailing ends of the sheets when the sheets are being discharged by the shutter for rising to close, when the post-processing of the sheets is not selected and the sheets are discharged to the sheet discharge tray, an opening of a processing tray.

7. The sheet discharging method of a sheet post-processing apparatus according to claim 6, wherein the processing tray is disposed in the sheet post-processing apparatus to be high on a sheet leading end side and low on a sheet trailing end side in the sheet conveying direction, and the support member is inclined upward at an angle equal to or larger than an angle of installation of the processing tray.

8. The sheet discharging method of a sheet post-processing apparatus according to claim 6, wherein the sheet post-processing apparatus further comprises a sheet discharging roller that conveys the sheets delivered from the processing tray; and the support member is arranged lower than a disposed position of the sheet discharging roller.

9. The sheet discharging method of a sheet post-processing apparatus according to claim 6, wherein the support member is formed of a conductor and provided in a metal part of the discharge port.

10. The sheet discharging method of a sheet post-processing apparatus according to claim 6, wherein a plurality of the support members are provided in a section of the discharge port located in an area where bundles of sheets alternately discharged for each predetermined number of sheets overlap one another.

* * * * *